US007194787B2

(12) United States Patent
Murai et al.

(10) Patent No.: US 7,194,787 B2
(45) Date of Patent: Mar. 27, 2007

(54) SHEET ATTACHING INSTRUMENT AND SHEET ATTACHMENT MEMBER

(75) Inventors: Ryukichi Murai, Toyama (JP); Yasutaka Nishida, Tokyo (JP); Ryoichiro Uehara, Kurobe (JP); Yasuaki Funo, Kurobe (JP)

(73) Assignee: YKK Corporation, Tokyo (JP)

( * ) Notice: Subject to any disclaimer, the term of this patent is extended or adjusted under 35 U.S.C. 154(b) by 14 days.

(21) Appl. No.: 10/834,772

(22) Filed: Apr. 28, 2004

(65) Prior Publication Data

US 2004/0226149 A1 Nov. 18, 2004

(30) Foreign Application Priority Data

May 12, 2003 (JP) ..... 2003-132757

(51) Int. Cl.
*A44B 21/00* (2006.01)
*A44B 11/25* (2006.01)

(52) U.S. Cl. ..... 24/615; 24/614; 24/625

(58) Field of Classification Search ..... 24/614, 24/615, 265 EC, 265 BC, 271, 272, 700
See application file for complete search history.

(56) References Cited

U.S. PATENT DOCUMENTS 6,622,355 B2 * 9/2003 Buscart et al. ..... 24/615

FOREIGN PATENT DOCUMENTS

| | | |
|---|---|---|
| EP | 0331547 | 9/1989 |
| EP | 1325690 | 7/2003 |
| FR | 2228351 | 11/1974 |
| GB | 2077342 | 12/1981 |
| KR | 0110680 | 10/1997 |
| KR | 20-0268089 | 3/2002 |

* cited by examiner

*Primary Examiner*—Robert J. Sandy
*Assistant Examiner*—Ruth C. Rodriguez
(74) *Attorney, Agent, or Firm*—Everest Intellectual Property Law Group; Michael S. Leonard

(57) ABSTRACT

A sheet attaching instrument (10) that includes an instrument body (11) and an attachment member (12), in which at least one engaging hole (50) is provided with a fall-stop (58) that can hold an attachment projection (30) in an area between an inserting section (51) and a holding section (52), and at least one peripheral edge of a pair of lateral side areas extending from the inserting section (51) to the holding section (52) through the fall-stop (58) is provided with a bridge (54) of which middle section is elastically deformable.

8 Claims, 13 Drawing Sheets

SHEET ATTACHING INSTRUMENT AND SHEET ATTACHMENT MEMBER

BACKGROUND OF THE INVENTION

1. Field of the Invention

The present invention relates to a sheet attaching instrument and a sheet attachment member, more particularly, to an instrument for attaching a belt or a tape etc. to sheet products such as clothes, bags, and covers directly or through a buckle, a magnet catch, a belt adjuster, a clasp, a tape stopper, a code stopper, or the like.

2. Description of Related Art

Conventionally, clothes, bags, covers and the like are manufactured mainly from woven clothes and synthetic-resin sheets etc. In these sheet products, a buckle, a magnet catch or the like is attached for opening and closing a lid thereof, and a belt, a tape, or the like is attached as a grip for carrying them.

For instance, in order to close a flap for shutting an opening of a bag, a plug of a buckle is attached to a tip end of the flap and a corresponding socket is attached to a front surface of the bag.

To realize such attachment, an arrangement has been employed in which a socket body and plug body are arranged on a front side of a sheet and an attachment member is arranged on a back side of the sheet in a manner such that these attachment members are coupled with the respective bodies to sandwich the sheet.

The following is an art disclosed in the Republic of Korea Registered Utility Model Gazette No.20-0268089 (Conventional Example 1).

Referring to FIG. 12, a sheet attaching instrument 101 includes a socket 100 (instrument body) of a buckle that is attached to a front surface of a sheet and an attachment member 200 that is arranged on a back surface of the sheet.

The socket 100 has a plurality of attachment projections 110 that penetrate the sheet to the back surface thereof, and an enlarging section enlarged in a predetermined direction is formed at each tip end of the attachment projections 110.

The attachment member 200 has a plurality of engaging holes 210 and a notch 220 that engage with the respective attachment projections 110. Each of the engaging holes and the notch has an inserting section (a wide opening section) into which the enlarging section can be inserted, a holding section (a narrow opening section) that can hold the enlarging section, and a fall-stop 221 that can hold the attachment projection in an area between the inserting section and the holding section.

In the engaging hole 210, the fall-stop thereof consists of a projection 211 extending from a side edge opposing to that of the other engaging hole 210. The attachment projection 110 is inserted into the engaging hole 210 from the inserting section, and then moved to the holding section to be held. In this process, when the attachment projection 110 heads to the holding section, the projection 211 of the fall-stop, that is extended toward the holding section, is elastically deformed to allow it to pass by. However, once the attachment projection 110 reaches the holding section, the projection 211 prohibits it from returning to the inserting section, thus a fall-stop function is provided.

In the notch 220, auxiliary notches are formed on both sides thereof in a manner such that the notch 220 is formed between a pair of projections 221. The holding section consists of a depth section of the pair of projections 221, whereas the pair of projections 221, i.e. the fall-stops consist of mutually facing step sections 223 formed between the inserting section, i.e., tip ends of the projections, and the holding section.

The attachment projection 110 is inserted into the notch 220 from the tip end side of the pair of the projections 221, and then moved to the holding section to be held. In this process, when the attachment projection 110 heads to the holding section, the pair of projections 221 are elastically deformed to allow it to pass by. However, once the attachment projection 110 reaches the holding section, the step sections 223 of the fall-stops 221, that have big steps on the holding side thereof, prohibit it from returning to the inserting section, thus a fall-stop function is provided.

With the attachment projections 110 and the engaging holes 210 or the notch 220, the socket 100 and the attachment member 200 are engaged with each other by being relatively moved in a predetermined direction heading from the inserting sections to the holding sections, thus enabling the sheet attaching instrument 101 to be attached to the sheet.

The following is another art disclosed in the Republic of Korea Registered Utility Model Gazette No.0110680 (Conventional Example 2).

Referring to FIG. 13, a sheet attaching instrument 300 includes a socket 310 (instrument body) of a buckle that is attached to a front surface of a sheet 301 and an attachment member 320 that is arranged on a back surface of the sheet 301.

The socket 310 has a plurality of attachment projections 311 that penetrate the sheet to the back surface thereof, and an enlarging section 312 enlarged in a predetermined direction is formed at each tip end of the attachment projections 311.

The attachment member 320 has a plurality of engaging holes 321 and a notch 324 that engage with the respective attachment projections 311. Each of the engaging holes and the notch has a protrusion at an end of an inner circumference in a predetermined direction, designating a section with the protrusion as a holding section (a narrow opening section) that can hold the enlarging section, a section without the protrusion as an inserting section (a wide opening section) into which the enlarging section can be inserted.

In the engaging hole 321, a fall-stop consists of a projection 322 extending from an opposite side of the holding section into the inserting section. The attachment projection 311 is inserted into the inserting section by pressing the projection 322 upward, and then moved to the holding section to be held by the protrusion 323. When the attachment projection 311 is placed into the holding section, the projection 322 is released from the press-up state to return to the original position inside the inserting section. Consequently, the projection 322 prohibits the attachment projection 311 from returning into the inserting section, thus a fall-stop function is provided.

In the notch 324, no fall-stop is formed, so that the holding section simply holds the attachment projection 311. However, since the attachment projections 311 in the above-mentioned engaging holes 321 are held therein, the attachment projection 311 in the notch 324 is also kept to be held.

With the attachment projections 311 and the engaging holes 321 or the notch 324, the socket 310 and the attachment member 320 are engaged with each other by being relatively moved in a predetermined direction heading from the inserting sections to the holding sections, thus enabling the sheet attaching instrument 300 to be attached to the sheet.

As described above, the sheet attaching instrument 101 according to the Conventional Example 1 uses the projections 211 and the projections 221 as fall-stops. The sheet attaching instrument 300 according to the Conventional Example 2 also uses the projections 322 as fall-stops.

The fact that all of the projections 211, the projections 221 and the projection 322 are cantilevered elastic projections brings a disadvantage in that they tend to be caught by other objects upon the handling in a disassembled state. It also brings another disadvantage in that, if a strong force is accidentally applied to the projections being caught by other objects, they are largely deformed and possibly damaged.

SUMMARY OF THE INVENTION

A primary object of the present invention is to provide a sheet attaching instrument and a sheet attachment member that are hardly caught by unexpected objects and easy to handle.

The present invention provides a sheet attaching instrument, including: an instrument body that is attached to a sheet; and an attachment member that is arranged on the sheet and engaged with the instrument body by being moved relative to the instrument body, in which either one of the instrument body and the attachment member has a plurality of attachment projections that penetrate the sheet, and enlarging sections that are respectively enlarged from the attachment projections;

the other one of the instrument body and the attachment member has a plurality of engaging holes that engage with the respective attachment projections, the engaging holes each having an inserting section into which the enlarging section can be inserted, and a holding section that continuously extends to the inserting section and can hold the enlarging section; and at least one of the engaging holes has a fall-stop that can hold the attachment projection in an area between the inserting section and the holding section, at least one peripheral edge of a pair of lateral side areas extending from the inserting section to the holding section through the fall-stop is a bridge which is elastically deformable.

The present invention provides a sheet attachment member that is arranged on a sheet and engaged with an instrument body by being moved relative to the instrument body for attaching the instrument body to the sheet, including: a plurality of engaging holes that are formed on the instrument body and penetrate the sheet, the engaging holes each having an inserting section into which an enlarging section enlarged from each of the attachment projections can be inserted, and a holding section that continuously extends to the inserting section and can hold the enlarging section;

in which at least one of the engaging holes has a fall-stop that can hold the attachment projection in an area between the inserting section and the holding section, and at least one peripheral edge of a pair of lateral side areas from the inserting section to the holding section through the fall-stop is a bridge which is elastically deformable.

In the present invention, the instrument body and the attachment member are mutually engaged to be attached to the sheet by arranging the instrument body and the attachment member respectively, for instance, on the front and the back surfaces of the sheet, inserting the attachment projections into the engaging holes, and then sliding them in the predetermined direction.

At the same time, the attachment projections are held by being moved from the inserting sections to the holding sections in the engaging holes. In this state, fall-stops prohibit the attachment projections from falling off as in the conventional ways. In the present invention, however, each of the fall-stops is so formed to be a bridge with both ends of which being fixed to the attachment member (or the instrument body).

In other words, since, for example, a middle section of the bridge is elastically deformable, the bridge, as the fall-stop, can allow the attachment projection to pass by or can hold it. As both ends of the bridge do not have projected shapes, that is, the bridge does not have conventional cantilevered projections, it is not caught by other objects, thereby achieving easier handling as compared to the conventional arts.

In the present invention, it is preferable a slit is formed along the outer circumference of the engaging hole, and the bridge is formed between the slit and the engaging hole.

With this arrangement, a peripheral edge of the engaging hole can be easily formed as the bridge by forming the slit along the outer circumference of the engaging hole.

In the present invention, it is preferable that an extension extending from an edge of the slit in a direction away from the engaging hole is formed, a cutting extending in the direction away from the engaging hole is formed on a peripheral edge adjacent to the bridge of the engaging hole, and the length of the bridge is prolonged with the extension and the cutting.

With this arrangement, since the bridge is not only formed along the peripheral edge of the engaging hole, but also extended in the direction away from the engaging hole, the length of the bridge can be prolonged. Accordingly, the middle section of the bridge can ensure the elastic deformability, thus facilitating the passage of the attachment projection. As for the fall-stop function, it can be assured by the shape of the fall-stop and the like. Therefore, the function as the fall-stop can be improved and easily adjusted.

In the present invention, it is preferable that the fall-stop is a step that can hold the attachment projection when the attachment projection moves from the holding section toward the inserting section.

With this arrangement, even when the deformability of the bridge is enhanced, a fall-stop function can be improved. Accordingly the attachment operation is facilitated as well the satisfactory fall-stop function can be assured.

In the present invention, it is preferable that a projected tread is formed at the attachment projection and the step is formed in a claw shape capable of being engaged with the projected tread.

With this arrangement, the engagement between the claw-shaped step and the projected tread can further improve fall-stop function, thereby facilitating the attachment operation as well as assuring the satisfactory fall-stop function.

DETAILED DESCRIPTION OF THE PREFERRED EMBODIMENT(S)

An embodiment of the present invention will be described below with reference to attached drawings.

Figure 1:
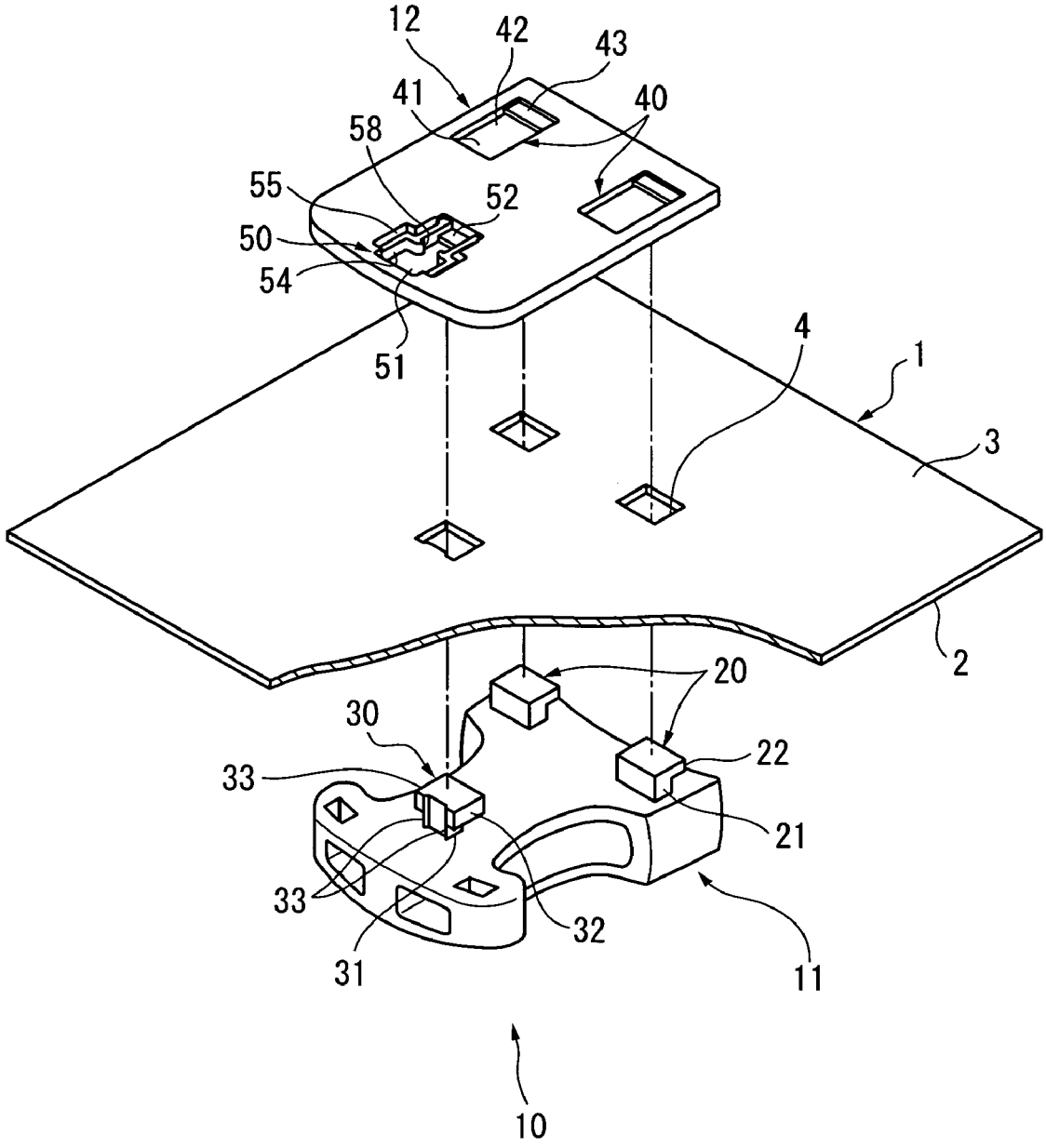
FIG. 1 is an exploded perspective view showing a sheet attaching instrument according to an embodiment of the present invention.
Figure 2:
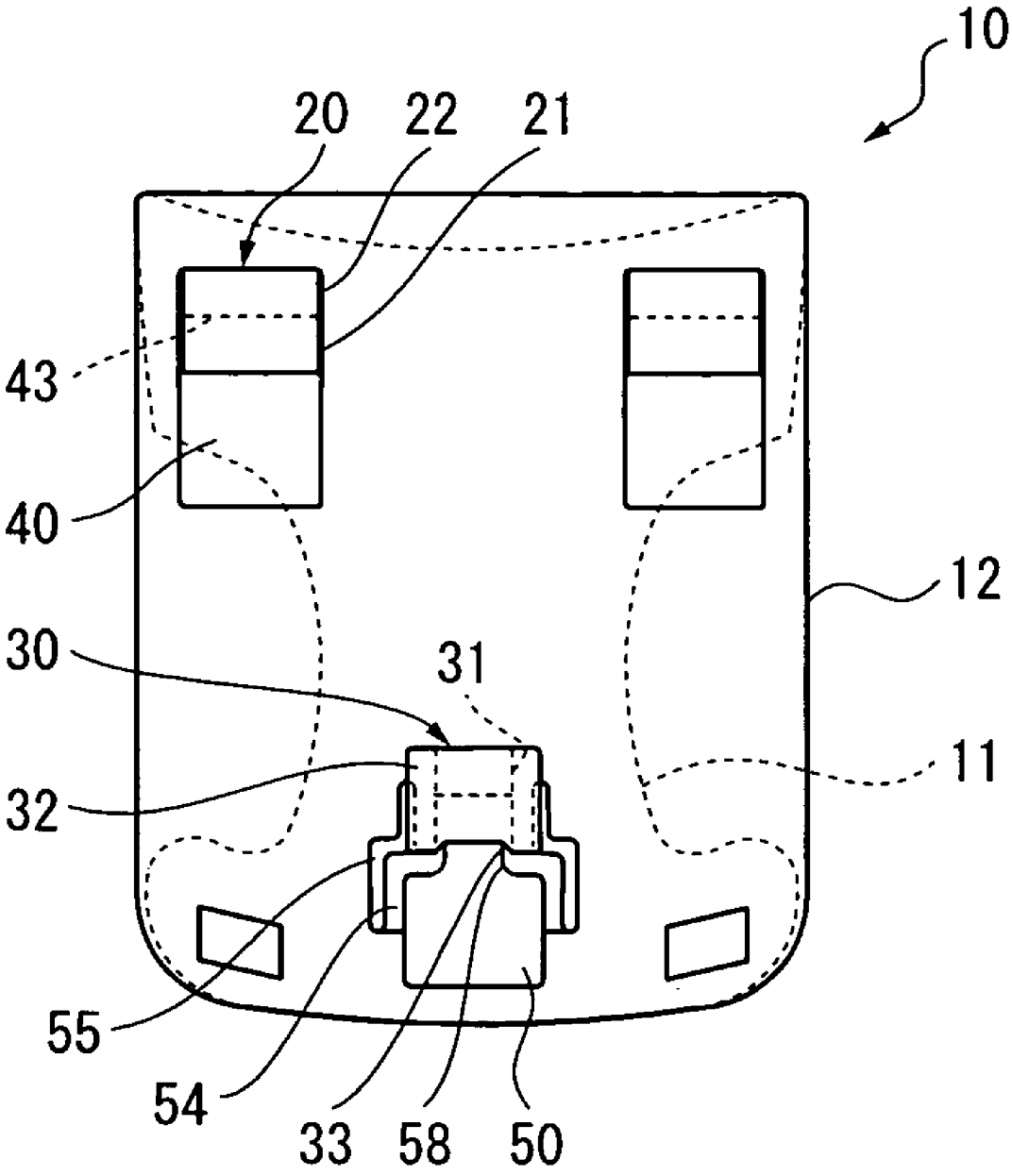
FIG. 2 is a rear elevation showing the sheet attaching instrument being assembled according to the embodiment.
Figure 3:
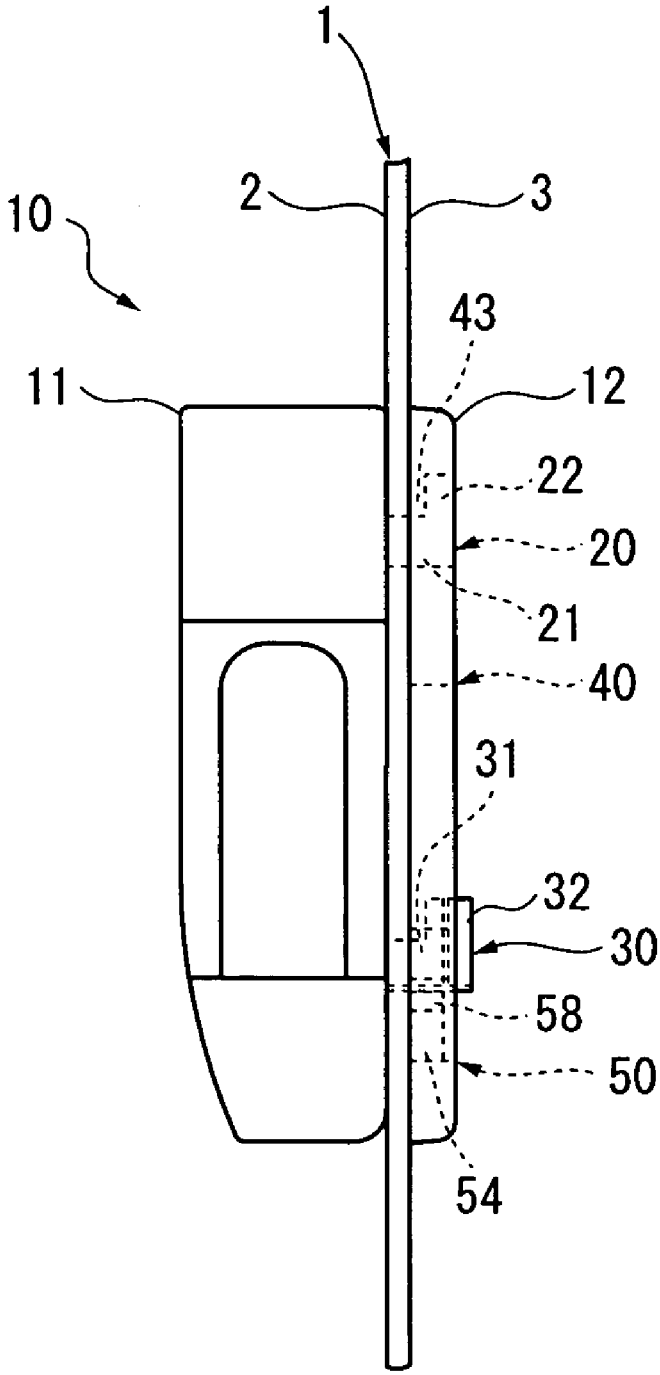
FIG. 3 is a side elevation showing the sheet attaching instrument being assembled according to the embodiment.

In FIGS. 1 to 3, a sheet attaching instrument 10 includes an instrument body 11 as a socket of a buckle and an attachment member 12 for attaching the instrument body 11 to a sheet 1.

The sheet 1 may be, for instance, a front cloth for a bag, in which the instrument body 11 is arranged on a front surface 2 and the attachment member 12 is arranged on a back surface 3.

In the sheet 1, holes 4 for coupling the instrument body 11 and the attachment member 12 are formed on a section to which the sheet attaching instrument 10 is attached. The holes 4 are formed according to a layout pattern in which the number and the position thereof correspond to those of below-described attachment projections 20, 30 of the instrument body 11 and engaging holes 40, 50 of the attachment member 12.

Figure 4:
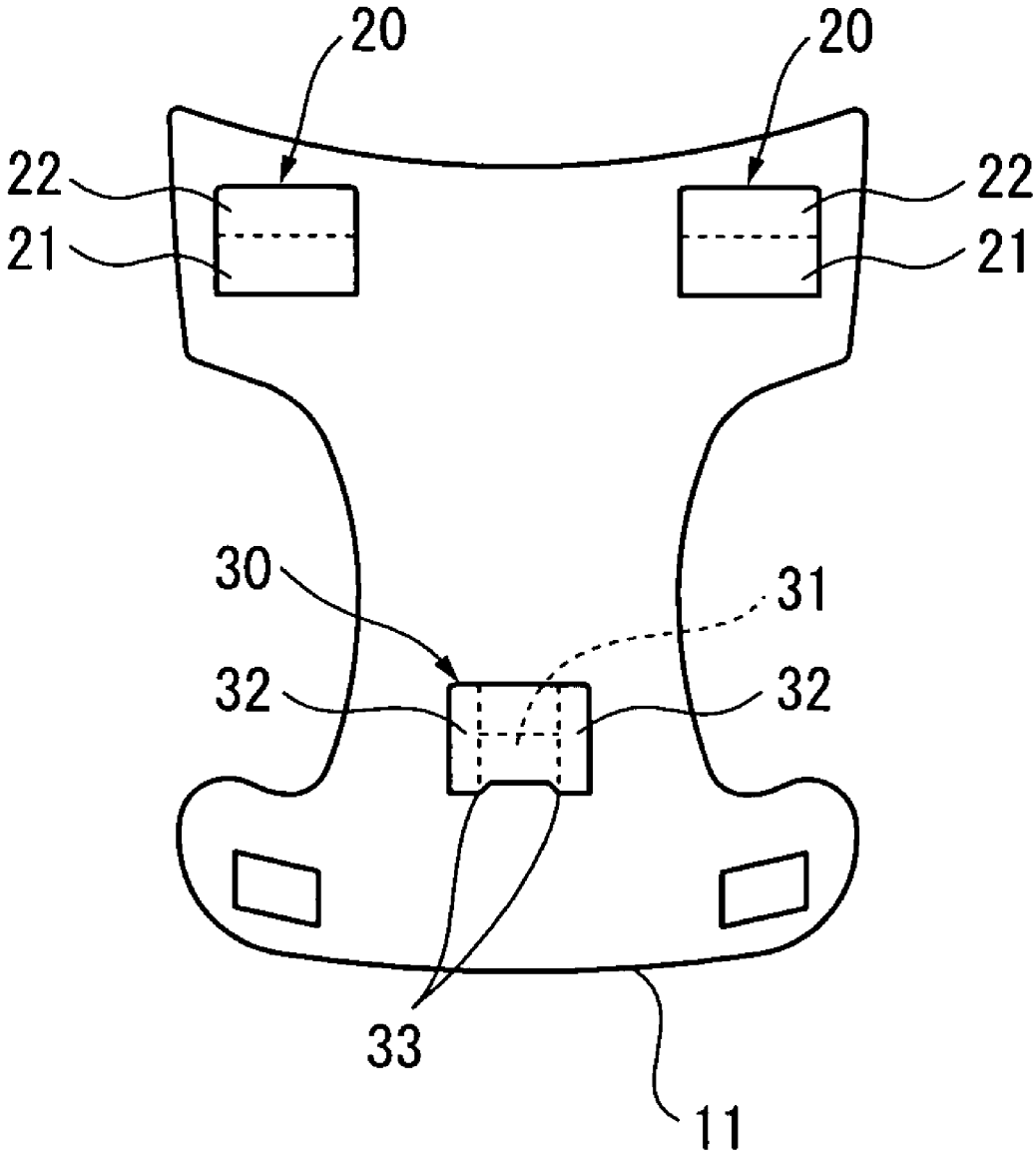
FIG. 4 is a rear elevation showing an instrument body according to the embodiment.
Figure 5:
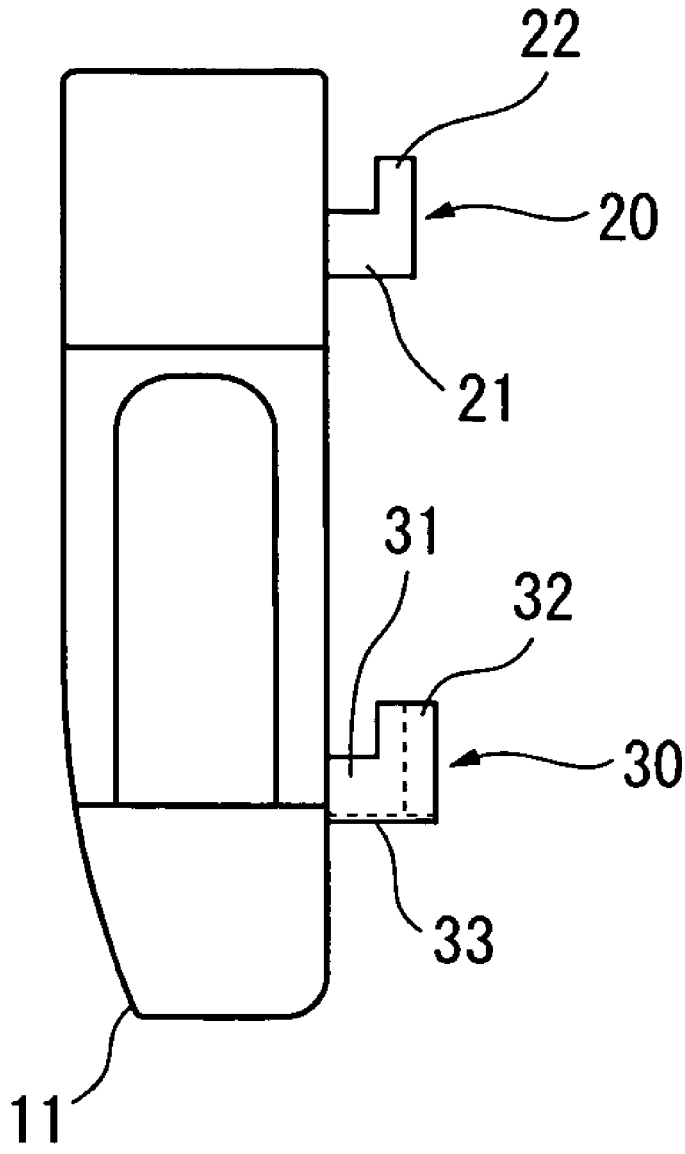
FIG. 5 is a side elevation showing the instrument body according to the embodiment.
Figure 6:
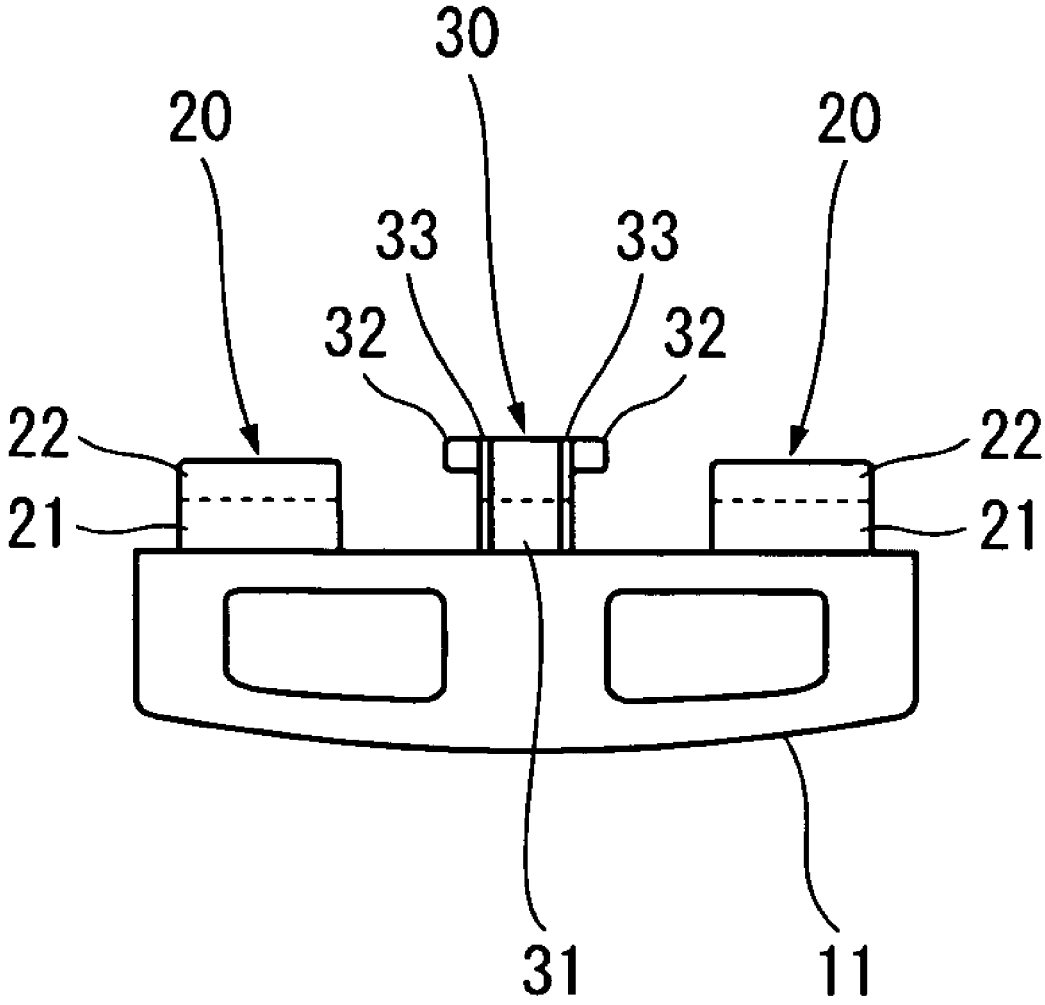
FIG. 6 is a bottom view showing the instrument body according to the embodiment.

As shown in FIGS. 4 to 6, the instrument body 11 is the socket of the buckle, and can be coupled with and decoupled from a plug of the buckle (not shown).

The instrument body 11 includes a plurality of attachment projections 20, 30 on a back surface thereof (a surface facing to the front surface 2 of the sheet 1). The attachment projections 20, 30 are exposed to the back surface 3 of the above-described sheet 1 from the front surface 2 through the holes 4 so as to be engaged with engaging holes 40, 50 of the attachment member 12.

The two attachment projections 20 are arranged on a side from which the plug of the instrument body 11 is inserted (upper side in the FIGS. 4 and 5, which is hereafter referred to as front side).

Each of the attachment projections 20 includes a shaft 21 that uprises from the back surface of the instrument body 11 and an enlarging section 22 that is so enlarged to project from a tip end of the shaft 21 to the front side.

The single attachment projection 30 is arranged on a side opposite to the side from which the plug of the instrument body 11 is inserted (lower side in the FIGS. 4 and 5, which is hereafter referred to as rear side).

The projection 30 includes a shaft 31 that uprises from the back surface of the instrument body 11 and an enlarging section 32 that is enlarged from a tip end of the shaft 31 to the front side and to both lateral sides.

A ridged section of the rear side of the shaft 31 has a cross-sectional shape formed in acute angles so as to form a projected tread 33 throughout substantially overall length of the shaft 31.

Figure 7:
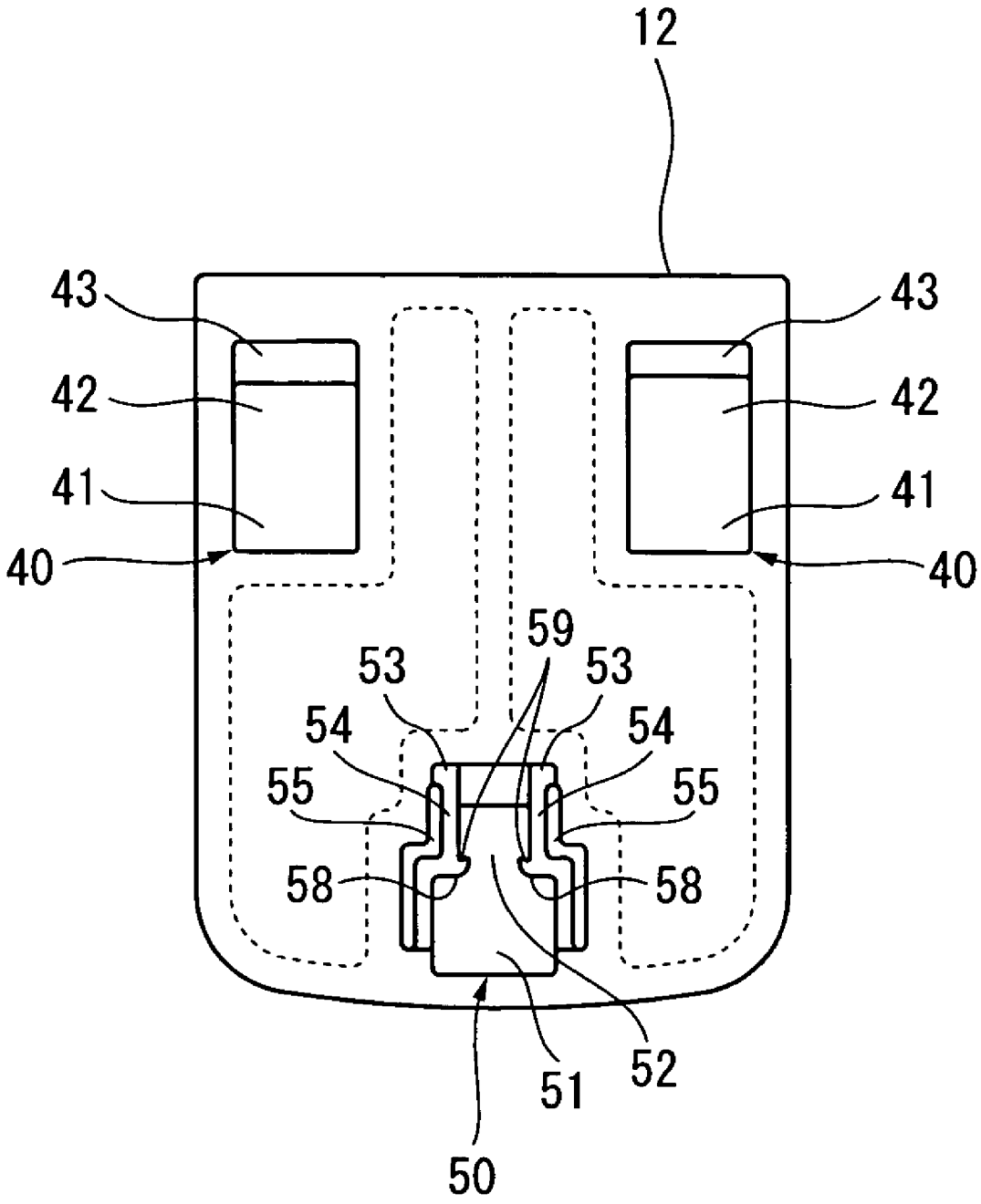
FIG. 7 is a rear elevation showing an attachment member according to the embodiment.
Figure 8:
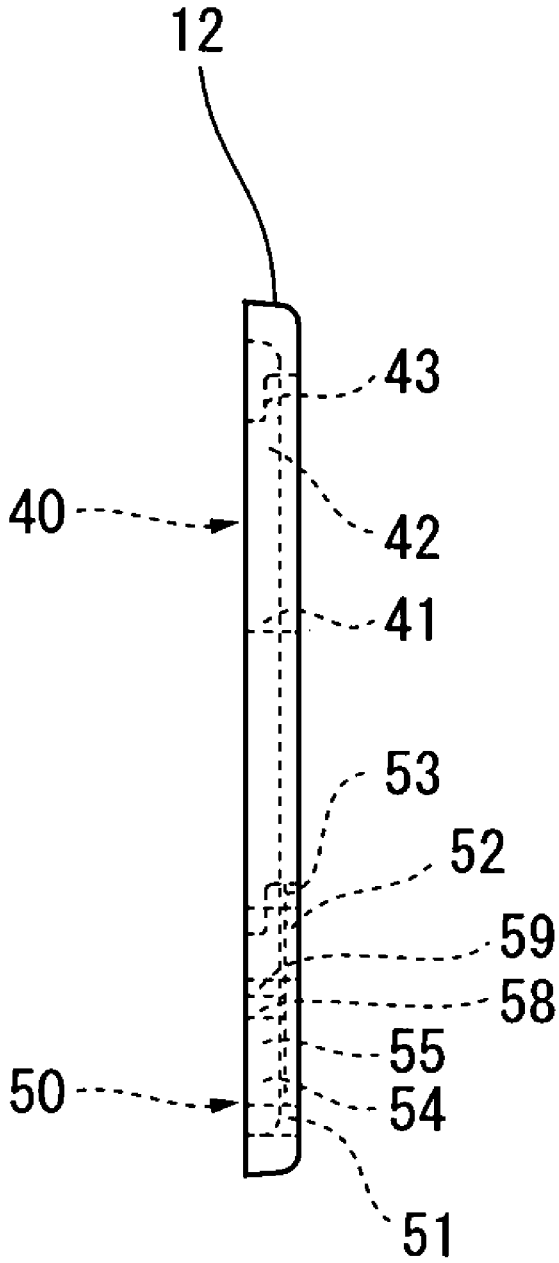
FIG. 8 is a side elevation showing the attachment member according to the embodiment.
Figure 9:
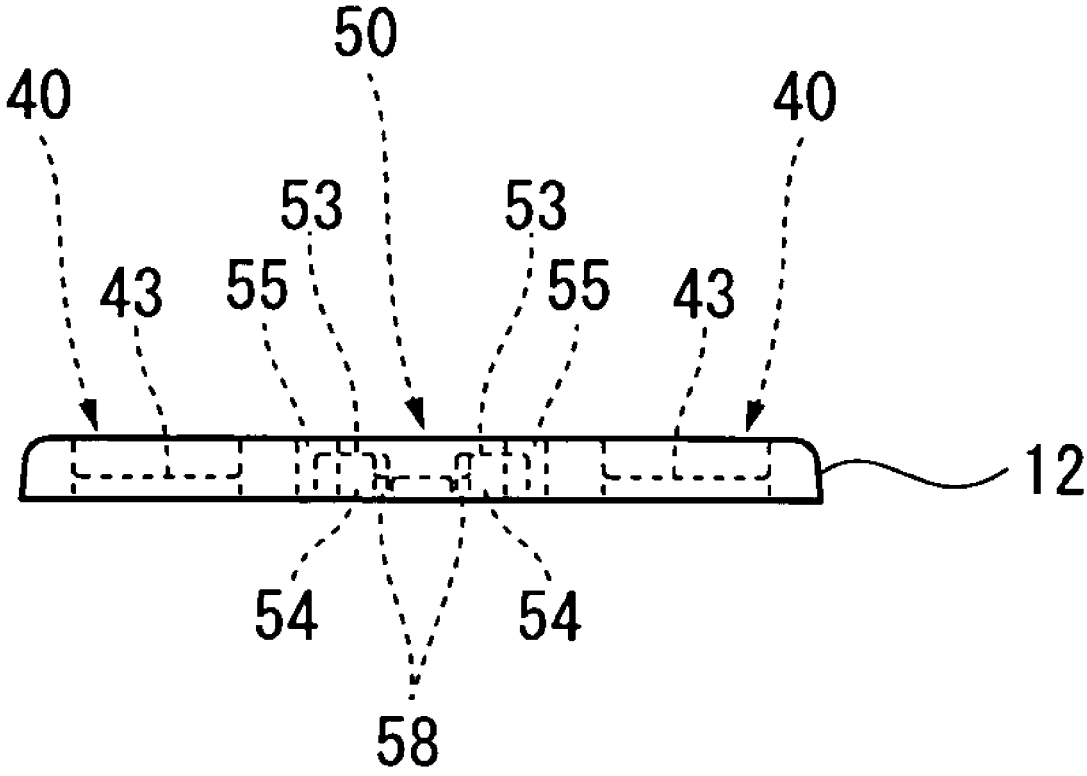
FIG. 9 is a bottom view showing the attachment member according to the embodiment.

As shown in FIGS. 7 to 9, the attachment member 12 fixes the sheet 1 by sandwiching it from the back surface of the instrument body 11.

The attachment member 12 is basically formed in a thin-plate shape so as not to add unnecessary bulkiness to the sheet 1.

In the attachment member 12, a plurality of engaging holes 40, 50 that penetrate from the back surface thereof to the front surface are formed. The engaging holes 40, 50 are coupled with the above-described attachment projections 20, 30 of the instrument body 11 through the sheet 1.

The two engaging holes 40 are arranged on a front side of the attachment member 12 (upper side in FIGS. 7 and 8).

In each of the engaging holes 40, a rear side area of the attachment member 12 is designated as an inserting section 41 while a front side area is designated as a holding section 42.

In the inserting section 41, an inner circumference of the engaging hole 40 is so formed to be larger enough than the enlarging section 22 of the attachment projection 20.

Accordingly, if the instrument body 11 and the attachment member 12 are moved toward each other, the attachment projection 20 and the shaft 21 thereof can be inserted into the engaging hole 40. If the thus moved instrument body 11 and the attachment member 12 are moved away from each other, the attachment projection 20 can come off from the engaging hole 40 without any difficulty.

In the holding section 42, a step section 43 is so formed on a front side of the inner circumference of the engaging hole 40 to be leveled down from the front surface of the attachment member 12.

Accordingly, when the attachment projection 20 inserted into the inserting section 41 is moved in the front side direction, the enlarging section 22 steps on the step section 43. In this condition, even if the instrument body 11 and the attachment member 12 are tried to be moved apart from each other, the attachment projection 20 hardly comes off from the engaging hole 40. The attachment projection 20 is thus held in the engaging hole 40, so that the instrument body 11 and the attachment member 12 are kept to be coupled.

The single engaging hole 50 is arranged on a rear side of the attachment member 12 (lower side in FIGS. 7 and 8).

In the engaging hole 50, a rear side area of the attachment member 12 is designated as an inserting section 51 while a front side area is designated as a holding section 52.

In the inserting section 51, an inner circumference of the engaging hole 50 is so formed to be larger enough than the enlarging section 32 of the attachment projection 30.

Accordingly, if the instrument body 11 and the attachment member 12 are moved toward each other, the attachment projection 30 and the shaft 31 thereof can be inserted into the holding hole 50. If the thus moved instrument body 11 and the attachment member 12 are moved away from each other, the attachment projections 30 can come off from the holding hole 50 without any difficulty.

In the holding section 52, step sections 53 are so formed on both lateral sides of the inner circumference of the engaging hole 50 to be leveled down from the front surface of the attachment member 12. The distance between the step sections 53 on the both lateral sides, i.e., the opening width of the holding section 52, is smaller than the width of the enlarging section 32 of the attachment projection 30.

Accordingly, when the attachment projection 30 inserted into the inserting section 51 is moved in the front side direction, the enlarging section 32 step sections on the step sections 53. In this condition, even if the instrument body 11 and the attachment member 12 are tried to be moved apart from each other, the attachment projection 30 hardly comes off from the engaging hole 50. The attachment projection 30 is thus held in the engaging hole 50, so that the instrument body 11 and the attachment member 12 are kept to be coupled.

As described above, the instrument body 11 and the attachment member 12 are mutually coupled by being relatively moved in a predetermined direction (the front side direction) in a state where the attachment projections 20 and the engaging holes 40 are mutually engaged as well as the attachment projection 30 and the engaging hole 50 are mutually engaged. In contrast, they are decoupled by being relatively moved in an opposite direction (the rear side direction). To avoid such decoupling, the engaging hole 50 is provided with a fall-stop mechanism.

On both sides of the engaging hole 50, there are slits 55 that are formed along the outer circumference of the engaging hole 50 and bar-shaped bridges 54 that are peripheral edge sections of the engaging hole 50 along the slits 55.

The front side of each bridge 54 is incorporated with the step section 53. Keeping the front surface level of the front side, the bridge 54 stretches to a rear side i.e., the inserting section 51.

A middle section of the bridge 54 is cranked according to the opening width difference between the inserting section 51 and the holding section 52. A fall-stop 58 is formed at the corner of the cranked section.

The fall-stop 58 is a projection projecting from the bridge 54 toward the inside of the engaging hole 50, a tip end side of which being inclined toward the front side, i.e., from the inserting section 51 toward the holding section 52.

A claw-shaped step 59 is formed at the inclined side, i.e., the front side of the fall-stop 58. The step 59 is formed in a claw shape corresponding to the cross-sectional shape of the projected tread 33 formed at the shaft 31 of the attachment projection 30 of the instrument body 11. Therefore, when the attachment projection 30 is held in the holding section 52 of the engaging hole 50, the projected tread 33 and the step 59 are securely engaged, thus a secure fall-stop is realized.

Since the fall-stop 58 has a projection shape inclined toward the front side as described above, the resistance of the fall-stop 58 is reduced when the attachment projection 30 being inserted into the inserting section 51 of the engaging hole 50 is moved toward the holding section 52.

Further, the resistance of the fall-stop 58 is also reduced by the bridge 54 at the time of moving the attachment projection 30 to the holding section 52.

In other words, since the middle section of the bridge 54 at which the fall-stop 58 formed is in a floating state although both ends of the bridge 54 are fixed to peripheral sections of the engaging holes 50, the bridge 54 is elastically deformed at the time of moving the attachment projection 30 to the holding section 52, and thus the resistance can be reduced.

The above embodiment has following advantages.

By arranging the instrument body 11 and the attachment member 12 respectively on the front and back surfaces of the sheet 1, inserting the attachment projections 20, 30 into the engaging holes 40, 50, and then sliding them in a predetermined direction (a direction in which the instrument body 11 moves to the front side relative to the attachment member 12, i.e., the upper side in FIG. 3), the instrument body 11 and the attachment member 12 are mutually engaged and can be easily attached to the sheet 1.

The attachment projections 20, 30 are held by moving from the inserting sections 41, 51 to the holding sections 42, 52, and in such condition, the fall-stops 58 of the engaging hole 50 can function as the fall-stops.

Particularly, since each fall-stop 58 has the projecting tip end that is inclined to the front side and the claw-shaped step 59 that securely engages with the projected tread 33 of the attachment projection 30 to assure a fall-stop function, unexpected releases of the engagement between the attachment projections 20, 30 and the engaging holes 40, 50 can be certainly avoided.

Also, since the fall-stop 58 has the projecting tip end that is inclined to the front side, the movement of the attachment projection 30 to the holding section 52 can be facilitated. Additionally, since the fall-stop 58 is formed on the elastically deformable bridge 54, the movement of the attachment projection 30 can be further facilitated.

As both ends of the bridge 54 do not have projected shapes, that is, the bridge 54 does not have conventional cantilevered projections, it is not caught by other objects, thereby achieving easier handling as compared to the conventional arts.

In the present embodiment, since the slits 55 are formed along the outer circumference of the engaging hole 50 and the bridges 54 are formed between the slits 55 and the engaging hole 50, bridges 54 are readily formed at the peripheral edge of the engaging hole 50.

The present invention is not limited to the above described embodiment, but can be implemented in various embodiments including the following modifications.

In the above embodiment, the slits 55 are formed outside of the engaging hole 50 along the peripheral edge thereof to form the bridge 54. The slits 55 and bridges 54, however, may be formed as in the following manner.

Figure 10:
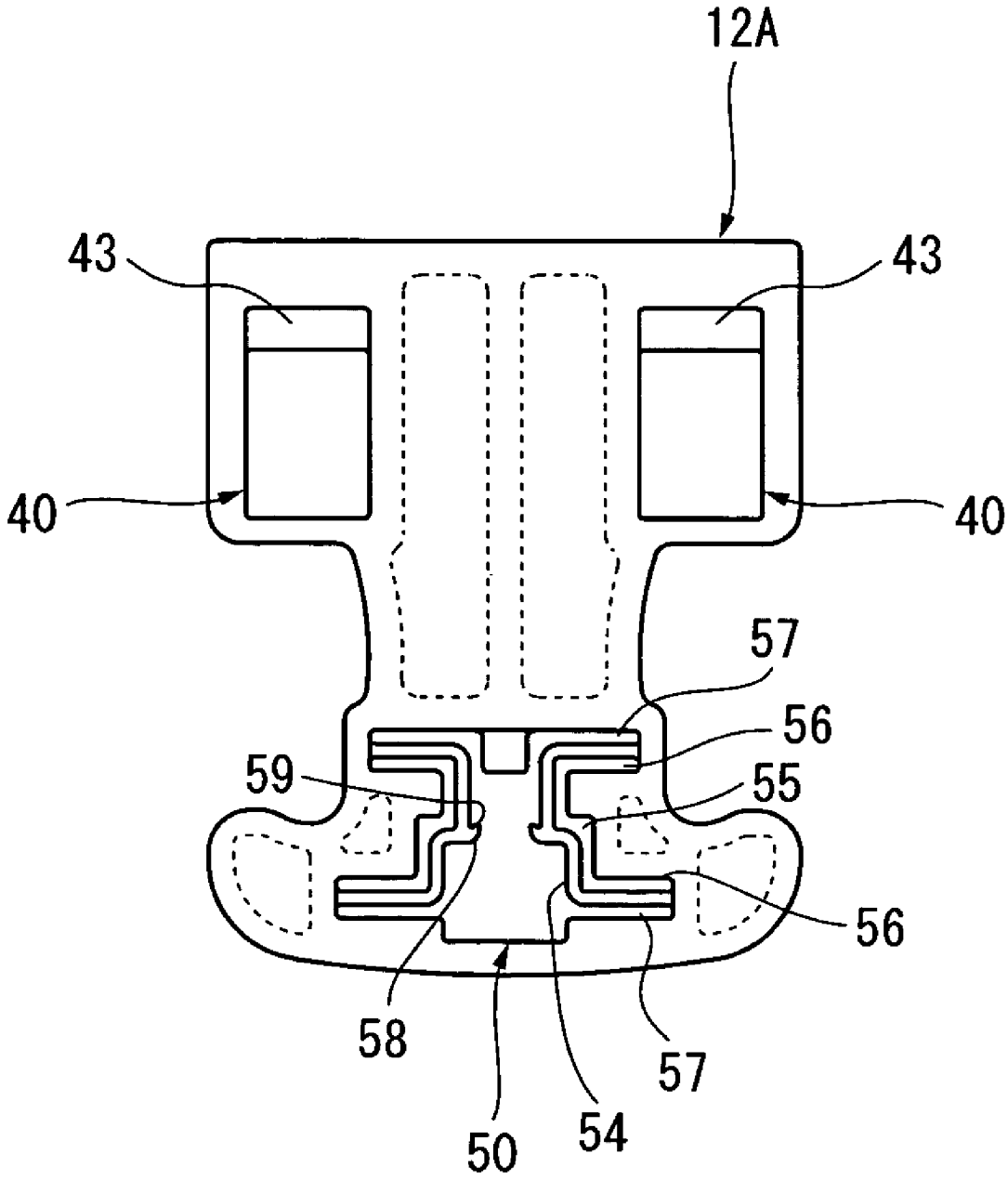
FIG. 10 is a rear elevation showing an attachment member according to a modification of the present invention.

In FIG. 10, the attachment member 12A basically has the same arrangement as the attachment member 12 of the above embodiment, but the arrangement around the engaging hole 50 is different.

On the outside of the engaging hole 50, slits 55 are formed along the peripheral edge and bridges 54 are formed between the slits 55 and the opening of the engaging hole 50.

Extensions 56 respectively extending in a direction away from the engaging hole 50 are formed at the end s of the slits 55. Also, cuttings 57 respectively extending in the direction away from the engaging hole 50 are formed on peripheral edge of the engaging hole 50 adjacent to the bridge 54.

With such extensions 56 and cuttings 57, the both ends of the brides 54 are extended in the direction away from the engaging hole 50. Namely, cranked sections along the engaging hole 50 are the same as those of the above embodiment, but the both ends are formed as extending sections sandwiched between the extensions 56 and the cuttings 57 and the bridges 54 are longer than those of the above embodiment.

With such arrangement, since the bridges 54 are formed not only along the peripheral edge of the engaging hole 50 but also extended in the direction away from the engaging hole 50, the length of the bridges 54 can be prolonged.

Accordingly, the middle sections of the bridges 54 can ensure the elastic deformability, thus facilitating the passage of the attachment projection 30.

Furthermore, the elastic deformability of the bridges 54 may be adjusted by adjusting the basic position and the length of the slits 55 (the width of the bridges 54). It may be adjusted with more flexibility by appropriately changing the length and the pattern of the extensions 56 and the cuttings 57.

In the above embodiment, the shaft 31 of the attachment projection 30 has a typical square shaped cross-section. The shape thereof, however, may be appropriately changed to improve the fall-stop function of the fall-stop 58 and to facilitate a holding operation, i.e., the movement to the holding section 52 (the movement in the front side direction).

Figure 11:
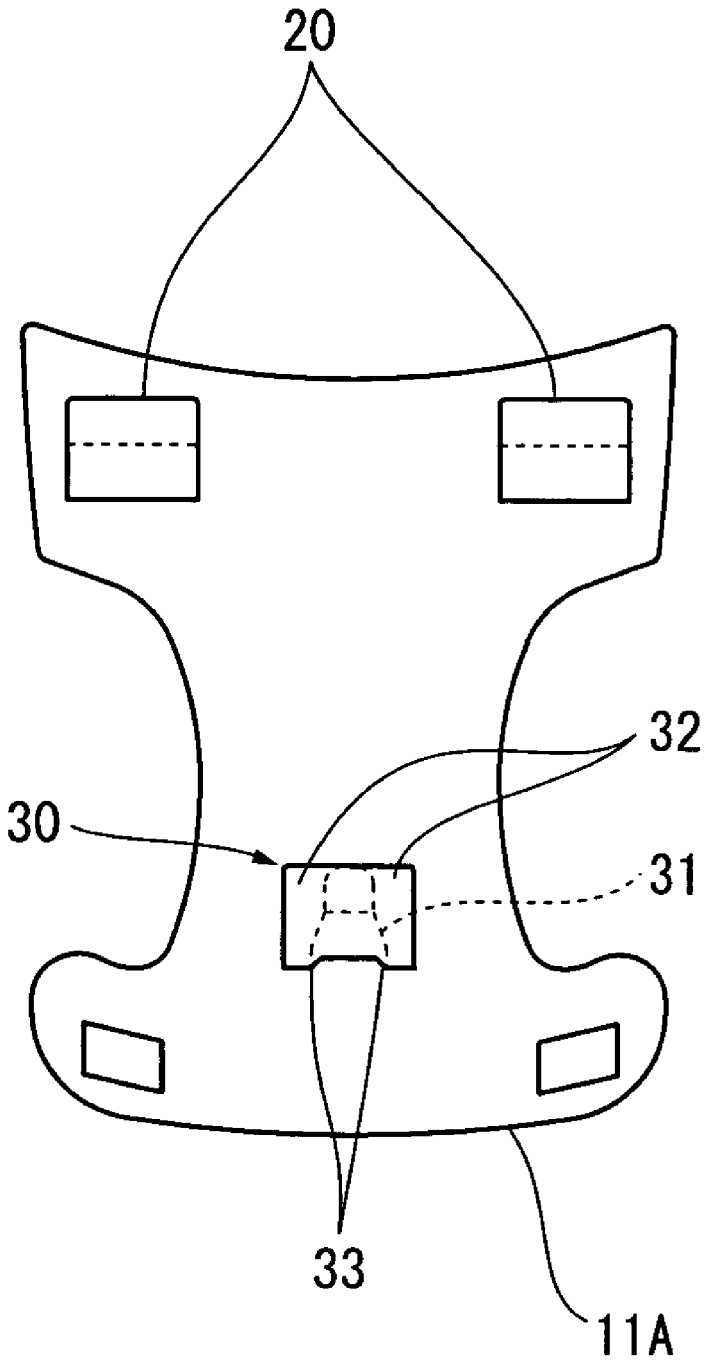
FIG. 11 is a rear elevation showing an instrument body according to another modification of the present invention.
Figure 12:
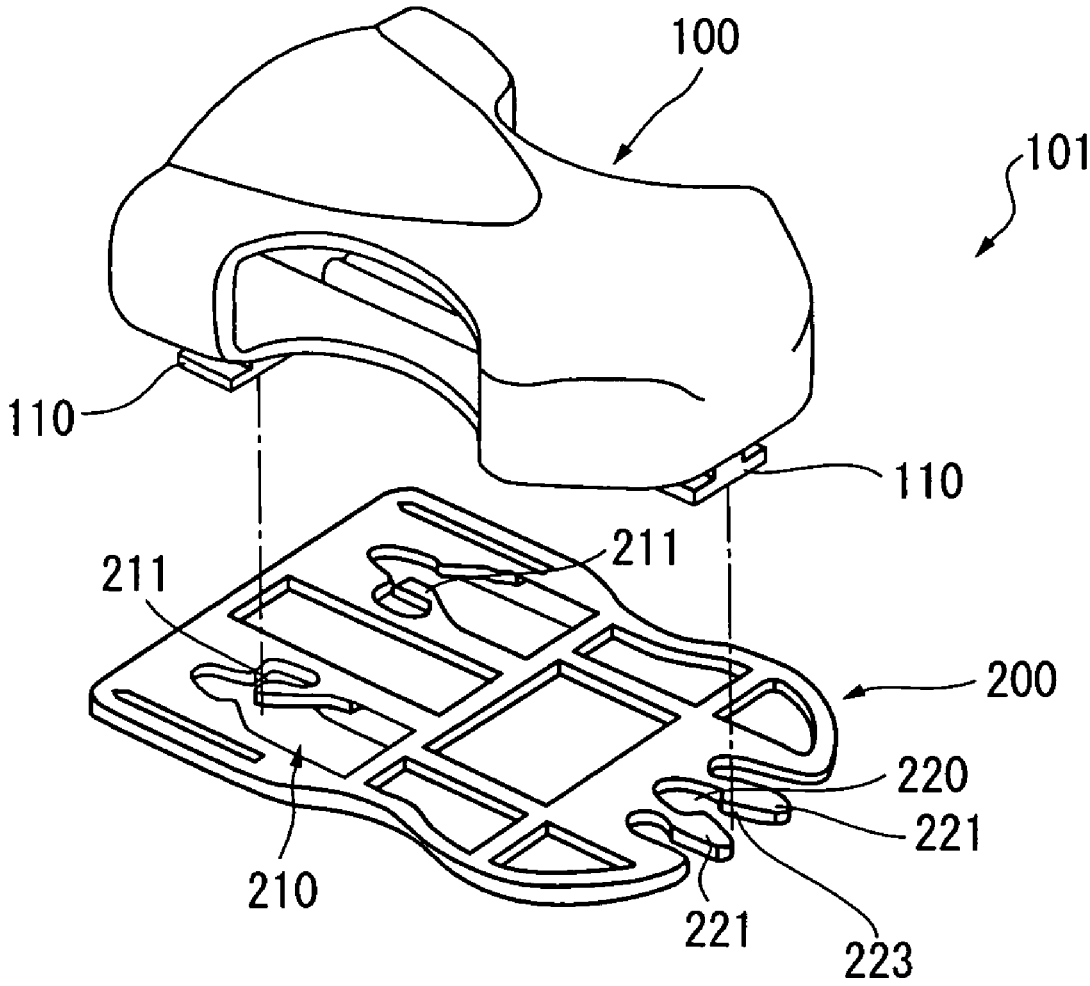
FIG. 12 PRIOR ART
FIG. 12 is an exploded perspective view showing a conventional sheet attaching instrument.
Figure 13:
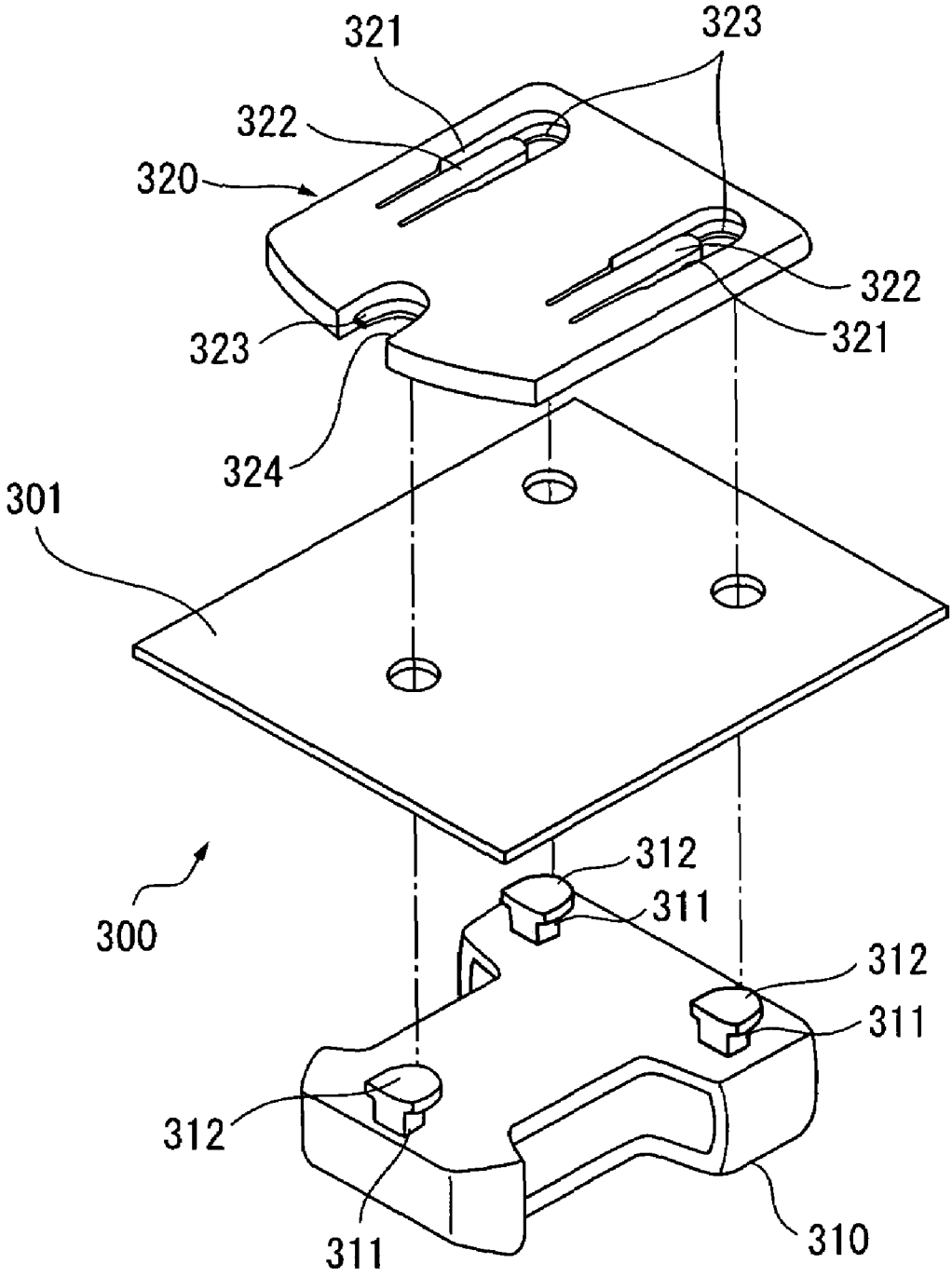
FIG. 13 PRIOR ART
FIG. 13 is an exploded perspective view showing another conventional sheet attaching instrument.

In FIG. 11, the instrument body 11A basically has the same arrangement as the instrument body 11 of the above embodiment, but the shape of the shaft 31 of the attachment projection 30 is different.

Concretely, the cross-section of the shaft 31 is a tapered shaped in which the rear side (lower side in the drawing) is wide and the front side (upper side in the drawing) is narrow.

With such arrangement, the wide section can be readily held in the fall-stop 58 when about to fall off from the holding section 52, and the narrow section can easily penetrate the fall-stop 58 upon the holding operation.

In the above embodiment, the engaging holes 40, 50 and the slits 55 are holes or openings that penetrate from the front surface to the back surface of the attachment member 12. However, each may be formed in a recess shape.

In other words, the engaging holes 40, 50 may have any shape as long as being able to hold the enlarging sections 22, 32 of the attachment projections 20, 30 when they are inserted. However, the penetrating holes or openings are effective for synthetic resin molding etc.

The direction in which the enlarging sections 22, 32 of the attachment projections 20, 30 project is not limited to the direction in the above embodiment, but may be appropriately selected as long as being able to be engaged by a movement in a predetermined direction. For instance, the enlarging section 32 of the attachment projection 30 is not limited to the one extending to the both lateral sides, but may be the one extending to only one side. The enlarging sections 22 of the attachment projections 20 may be those extending to both sides. The shape of the corresponding engaging holes 40, 50 may be so formed to enable appropriate engagements according to the enlarging sections 22, 32.

In the above embodiment, the bridge 54 is formed with use of the slit 55. The bridge 54, however, may be formed between the engaging hole 50 and a notch cut out from the outer circumference of the attachment member 12 on which the engaging hole 50 and the bridge 54 are formed. However, with the slit 55 formed along the outer circumference of the engaging hole 50 as in the above embodiment, the bridge 54 can be easily formed and the elastic deformability can be readily adjusted.

In the above embodiment, the engaging hole 50 with the fall-stop 58 and the bridge 54 is arranged at the rear side of the attachment member 12 and the engaging holes 40 without them are arranged on the front side. However, the rear side and the front side may be switched, and further, all the engaging holes may have a fall-stop 58 and a bridge 54.

In the above embodiment, the instrument body 11 has the attachment projections 20, 30, two of which arranged on the front side and one on the rear side while the attachment member 12 has the engaging holes 40, 50 arranged in the same manner. However, the number and the layout thereof may be appropriately changed upon the implementation of the invention.

In the above embodiment, the instrument body 11 is provided with the attachment projections 20, 30 while the attachment member 12 is provided with the engaging holes 40, 50. However, they may exchange the provided elements.

What is claimed is:

1. A sheet attaching instrument, comprising:

an instrument body that is attached to a sheet; and an attachment member that is arranged on the sheet and engaged with the instrument body by being moved relative to the instrument body, wherein either one of the instrument body and the attachment member has a plurality of attachment projections that penetrate the sheet, and enlarging sections that are respectively enlarged from the attachment projections;

the other one of the instrument body and the attachment member has a plurality of engaging holes that engage with the respective attachment projections, the engaging holes each having an inserting section into which the enlarging section can be inserted, and a holding section that continuously extends to the inserting section and can hold the enlarging section when the enlarging section steps on the holding section; and at least one of the engaging holes has a bridge on at least one peripheral edge of a pair of lateral side areas extending from the inserting section to the holding section, the bridge having opposite ends and being fixed to the at least one peripheral edge only at the opposite ends, the bridge having a middle section spaced away from the at least one peripheral edge by a slit extending continuously between the opposite ends of the bridge and being elastically deformable in a direction to be away from the at least one of the engaging holes, and a fall-stop on the middle section that protrudes toward the inside of the at least one of the engaging holes to hold the attachment projection.

2. The sheet attaching instrument according to claim 1, wherein an extension extending from an edge of the slit in a direction away from the engaging hole is formed, a cutting extending in the direction away from the engaging hole is formed on a peripheral edge adjacent to the bridge of the engaging hole, and the length of the bridge is prolonged with the extension and the cutting.

3. The sheet attaching instrument according to claim 1, wherein the fall-stop is a step that can hold the attachment projection when the attachment projection moves from the holding section toward the inserting section.

4. The sheet attaching instrument according to claim 3, wherein a projected tread is formed at the attachment projection and the step is formed in a claw shape capable of being engaged with the projected tread.

5. A sheet attachment member that is arranged on a sheet and engaged with an instrument body by being moved relative to the instrument body for attaching the instrument body to a front surface of the sheet, comprising:

a plurality of engaging holes that are formed on the instrument body and penetrate the sheet, the engaging holes each having an inserting section into which an enlarging section enlarged from each of the attachment projections can be inserted, and a holding section that continuously extends to the inserting section and can hold the enlarging section when the enlarging section steps on the holding section, wherein at least one of the engaging holes has a bridge on at least one peripheral edge of a pair of lateral side areas extending from the inserting section to the holding section, the bridge having opposite ends and being fixed to the at least one peripheral edge only at the opposite ends, the bridge having a middle section being spaced away from the at least one peripheral edge by a slit extending continuously between the opposite ends of the bridge and elastically deformable in a direction to be away from the at least one of the engaging holes, and a fall-stop on the middle section that protrudes toward the inside of the at least one of the engaging holes to hold the attachment projection.

6. The sheet attachment member according to claim 5, wherein an extension extending from an edge of the slit in the direction away from the engaging hole is formed, a cutting extending in the direction away from the engaging hole is formed on a peripheral edge adjacent to the bridge of the engaging hole, and the length of the bridge is prolonged with the extension and the cutting.

7. The sheet attachment member according to claim 5, wherein the fall-stop is a step that can hold the attachment projection when the attachment projection moves from the holding section toward the inserting section.

8. The sheet attachment member according to claim 7, wherein the step is formed in a claw shape to enable engagement with the projected tread formed at the attachment projection.

* * * * *